US009039589B2

(12) United States Patent
Rivera

(10) Patent No.: US 9,039,589 B2
(45) Date of Patent: May 26, 2015

(54) BEVERAGE POD PACKAGING MANUFACTURING MACHINE

(76) Inventor: Adrian Rivera, Whittier, CA (US)

( * ) Notice: Subject to any disclaimer, the term of this patent is extended or adjusted under 35 U.S.C. 154(b) by 602 days.

(21) Appl. No.: 13/011,899

(22) Filed: Jan. 22, 2011

(65) Prior Publication Data

US 2012/0190520 A1 Jul. 26, 2012

(51) Int. Cl.
*B31B 1/14* (2006.01)
*B31B 1/00* (2006.01)

(52) U.S. Cl.
CPC ..... *B31B 1/00* (2013.01); *B31B 2201/2654* (2013.01); *B31B 2203/00* (2013.01); *B31B 2203/062* (2013.01)

(58) Field of Classification Search
USPC ..... 493/56, 58, 61, 143, 153; 53/433, 452, 53/453, 511, 559
See application file for complete search history.

(56) References Cited

U.S. PATENT DOCUMENTS

| | | | | |
|---|---|---|---|---|
| 3,022,411 | A | 2/1962 | Soper et al. | |
| 3,218,776 | A | 11/1965 | Cloud | |
| 3,224,360 | A | 12/1965 | Wickenberg et al. | |
| 3,316,388 | A | 4/1967 | Wickenbert et al. | |
| 3,405,630 | A | 10/1968 | Weber, III | |
| 3,736,722 | A * | 6/1973 | Rosenberg | 53/526 |
| 3,757,670 | A | 9/1973 | Laama et al. | |
| 3,844,206 | A | 10/1974 | Weber | |
| 3,958,502 | A | 5/1976 | Vitous | |
| 4,437,293 | A * | 3/1984 | Sanborn, Jr. | 53/412 |
| 4,603,621 | A | 8/1986 | Roberts | |
| 4,703,687 | A | 11/1987 | Wei | |
| 4,706,555 | A | 11/1987 | Nakamura et al. | |
| 4,800,089 | A | 1/1989 | Scott | |
| 4,981,588 | A | 1/1991 | Poulallion | |
| 4,998,463 | A | 3/1991 | Precht et al. | |
| 5,000,082 | A | 3/1991 | Lassota | |
| 5,012,629 | A | 5/1991 | Rehman et al. | |
| 5,04,6409 | A | 9/1991 | Henn | |
| 5,081,819 | A | 1/1992 | Cloud | |
| 5,171,457 | A | 12/1992 | Acuff et al. | |
| 5,197,374 | A | 3/1993 | Fond | |
| 5,242,702 | A | 9/1993 | Fond | |
| 5,325,765 | A | 7/1994 | Sylvan et al. | |
| 5,459,980 | A | 10/1995 | Kenney et al. | |
| 5,555,705 | A | 9/1996 | Balcombe | |
| 5,632,133 | A | 5/1997 | Wyslotsky | |
| 5,636,563 | A | 6/1997 | Oppermann et al. | |
| 5,649,412 | A | 7/1997 | Binacchi | |
| 5,682,726 | A | 11/1997 | Green et al. | |
| 5,840,189 | A | 11/1998 | Sylvan et al. | |
| 5,895,672 | A | 4/1999 | Cooper | |
| 6,079,315 | A | 6/2000 | Beaulieu et al. | |
| 6,189,438 | B1 | 2/2001 | Bielfeldt et al. | |
| 6,202,542 | B1 | 3/2001 | Melton | |
| 6,499,388 | B2 | 12/2002 | Schmed | |
| 6,525,299 | B2 | 2/2003 | Hannon et al. | |

(Continued)

*Primary Examiner* — Sameh H. Tawfik
(74) *Attorney, Agent, or Firm* — Kenneth L. Green; Averill & Green

(57) ABSTRACT

A filter paper cup manufacturing machine produces filter paper cups packaging suitable for containing a brewing material. The filter paper cup packaging has similar depth and diameter. The machine exercises ordered steps of first cutting a receptacle portion and cover portion for each individual packaging and then forming a recess in the receptacle portion for receiving the brewing material. Performing the cutting step first facilitates forming the recess because surrounding filter paper which would resist forming the recess has been eliminated.

20 Claims, 6 Drawing Sheets

(56) References Cited

U.S. PATENT DOCUMENTS

| | | | |
|---|---|---|---|
| 6,591,585 | B2 | 7/2003 | Stolz |
| 6,655,260 | B2 | 12/2003 | Lazaris et al. |
| 6,658,989 | B2 | 12/2003 | Sweeney et al. |
| 6,662,531 | B1 | 12/2003 | Schwab et al. |
| 6,708,600 | B2 | 3/2004 | Winkler et al. |
| 6,727,484 | B2 | 4/2004 | Policappelli |
| 6,740,345 | B2 | 5/2004 | Cai |
| 6,777,007 | B2 | 8/2004 | Cai |
| 6,832,542 | B2 | 12/2004 | Hu et al. |
| 7,318,374 | B2 | 1/2008 | Buerror |
| 7,320,274 | B2 | 1/2008 | Castellani |
| 7,377,089 | B2 | 5/2008 | Rapparini |
| 7,946,217 | B2 | 5/2011 | Favre et al. |
| 2002/0035929 | A1 | 3/2002 | Kanba et al. |
| 2002/0148356 | A1 | 10/2002 | Lazaris et al. |
| 2003/0200872 | A1 | 10/2003 | Lin |
| 2003/0222089 | A1 | 12/2003 | Hale |
| 2004/0005384 | A1 | 1/2004 | Cai |
| 2004/0118290 | A1 | 6/2004 | Cai |
| 2005/0236323 | A1 | 10/2005 | Oliver et al. |
| 2005/0257695 | A1 | 11/2005 | Dobranski et al. |
| 2011/0274802 | A1 | 11/2011 | Rivera |
| 2012/0207895 | A1 | 8/2012 | Rivera |
| 2012/0207896 | A1 | 8/2012 | Rivera |
| 2012/0276264 | A1 | 11/2012 | Rivera |

* cited by examiner

BEVERAGE POD PACKAGING MANUFACTURING MACHINE

BACKGROUND OF THE INVENTION

The present invention relates to coffee brewing and in particular to efficiently manufacturing a filter paper cup.

Various methods of brewing coffee are known. A popular method is using a single serving pod or filter paper cup in a brewing machine designed to accept the corresponding pod or filter paper cup. Pods are generally disk like with a diameter much greater than the depth of the pod, where as a filter paper cup may have similar diameter and depth. Machines are know for efficiently manufacturing pods and described in U.S. Pat. No. 5,012,629 issued May 7, 1991, U.S. Pat. No. 5,649,412 issued Jul. 22, 1997, and U.S. Pat. No. 7,377,089 issued May 27, 2008. While these patents disclose useful methods to manufacture a typical coffee pod, they reply on methods for forming a brewing material receptacle from strips of flat filter paper material which is only suitable for a shallow receptacle because the filter paper cannot stretch to accommodate forming adjacent pods from a common strip of filter paper. Forming such shallow receptacles require minimum stretching or deformation of the filter paper to form adjacent pods. If these machines are merely scaled for a deeper receptacle, the filter paper would be unacceptably deformed or tear in the process. The '629, 412, and 089 patents are incorporated herein in their entirely by reference.

BRIEF SUMMARY OF THE INVENTION

The present invention addresses the above and other needs by providing a filter paper cup packaging manufacturing machine which produces filter paper cup packaging for containing a brewing material. The filter paper cup packaging has similar depth and diameter. The machine exercises ordered steps of first cutting a receptacle portion and cover portion for each individual packaging and then forming a recess in the receptacle portion for receiving the brewing material. Performing the cutting step first facilitates forming the recess because surrounding filter paper which would resist forming the recess has been eliminated.

In accordance with another aspect of the invention, there is provided a filter paper cup manufacturing machine comprising a number of sequentially arranged stations. The stations include a roll of first filter paper and a roller guiding the filter paper onto the belt; a cutting station used to perform a circular cut in the filter paper for forming each individual filter paper cup; a stamping station pressing a center portion of the cut filter paper into a corresponding recess in the belt to form a paper recess; a filling station to fill the paper recess in the filter paper with brewing material; a tamping station to tamp the brewing material residing in the paper recess; a vacuum station to remove excess brewing material from a rim of the receptacle portion; a roll of second filter paper and a second roller guiding the second filter paper over the receptacle portion; a seal station bonds the second filter paper to the receptacle portion; and a second cutting station cuts through the second filter paper to compete the filter paper cup.

In accordance with another aspect of the invention, there is provided a method for manufacturing filter paper cups. The method includes the steps of: cutting a separate receptacle portion for forming each individual filter paper cup, forming the receptacle portion; heating or dampening the formed receptacle portion to retain shape; filling the receptacle portion with brewing material; tamping the brewing material; vacuuming excess brewing material; fixing a cover portion over the receptacle portion; and cutting the completed pod.

In accordance with another aspect of the invention, there is provided method for manufacturing a filter paper cup packaging. The method includes: cutting separate attached receptacle portion and cover portion for forming each individual filter paper cup packaging; forming recesses in the receptacle portions; and heating or dampening the formed receptacle portions to retain shape.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figures 1, 2:
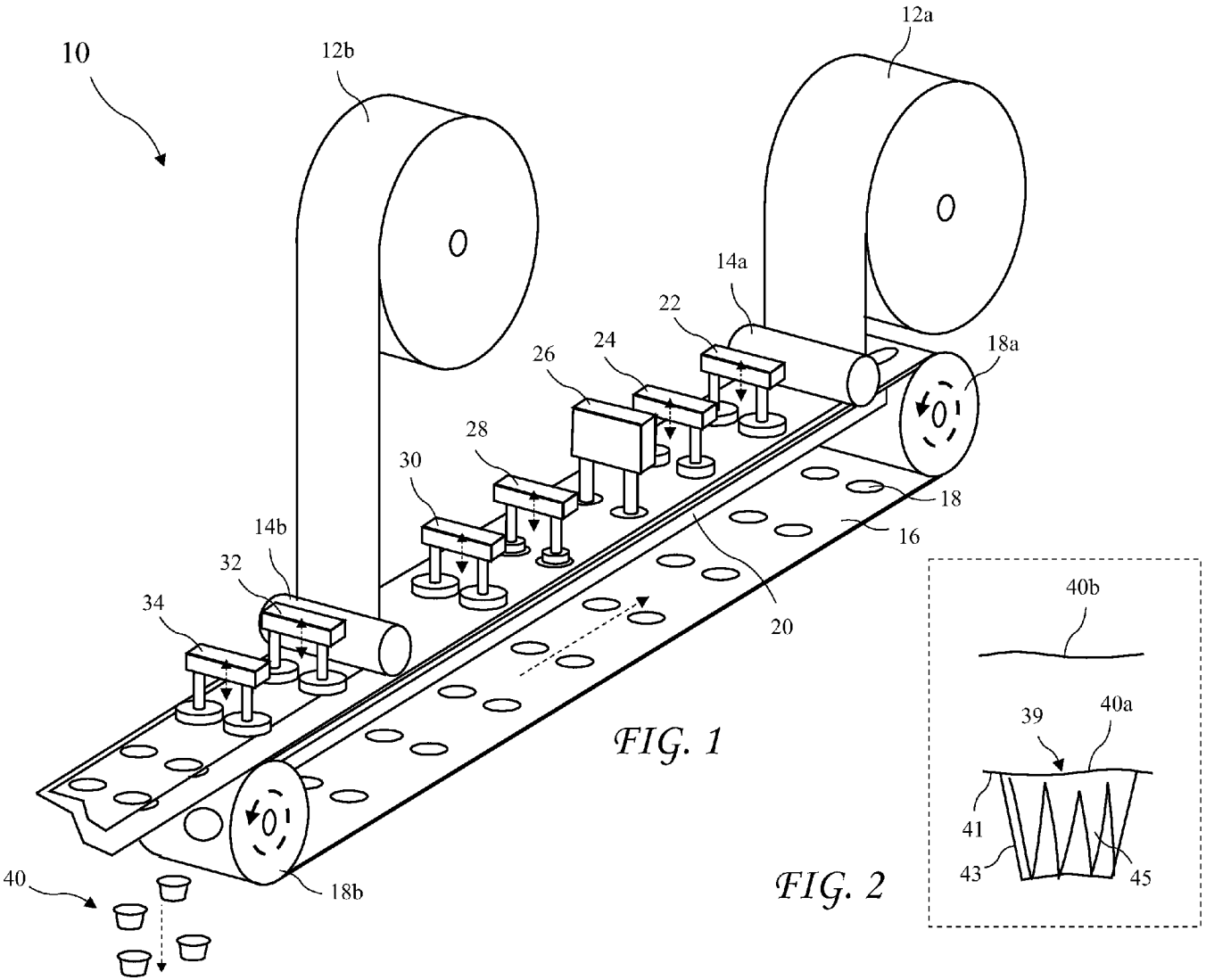
FIG. 1 is a filter paper cup manufacturing machine according to the present invention.
FIG. 2 shown a cover portion and receptacle portion of a filter paper cup according to the present invention.

A filter paper cup manufacturing machine 10 according to the present invention is shown in FIG. 1. The filter paper cup manufacturing machine 10 includes a belt 16 running around two rollers 18*a* and 18*b*. The belt 16 includes belt recesses 18 used for forming and holding filter paper cup receptacle portions during the manufacturing of filter paper cups 40. A vacuum table 20 resides under the higher path of the belt 16 to hold first filter paper material 12*a* and the lower portions 40*b* (see FIG. 2) as they are formed and filled with brewing material.

A series of ordered stations process filter paper to manufacture the completed filter paper cups 40. The stations comprise: a roll of first filter paper 12*a* and a roller 14*a* guiding the filter paper 12*a* onto the belt 16; a cutting station 22 used to perform a circular cut in the filter paper 12*a* to create separate pieces of filter paper for forming each individual filter paper cup; a stamping station 24 pressing a center portion of the cut filter paper into a corresponding recess 18 in the belt 16 to form a paper recess 39 and using heat or dampening to retain the shape of the recess 39; a filling station 26 to fill the paper recess 39 in the filter paper 12*a* with brewing material; a tamping station 28 to tamp the brewing material residing in the paper recess 39; a vacuum station 30 to remove excess brewing material from a rim 41 of the receptacle portion 40*a*; a roll of second filter paper 12*b* and a second roller 14*b* guiding the second filter paper 12*b* over the receptacle portion 40*a*; a seal station 32 bonds the second filter paper to the receptacle portion 40*a*; and a second cutting station 34 cuts through the second filter paper 12*b* to compete the filter paper cup 40.

The stations of the filter paper cup manufacturing machine 10 are similar to stations of U.S. Pat. No. 5,649,412 (incorporated by reference above), but significantly, the first station is the cutting station 22 which cuts substantially all of the perimeter of the receptacle portion 40*a* from the first filter paper 12*a* and the receptacle portion 40*a* is held against the belt 16 for subsequent stations by vacuum provided by the vacuum table 20. While it is preferred to cut the receptacle portion 40*a* entirely away from the first filter paper 12*a* to allow for forming the recess 39 in the receptacle portion 40*a*, a small attachment between the receptacle portion 40*a* and the filter paper 12*a* to, for example, help control the position of the receptacle portion 40*a* during processing at subsequent stations.

While the stations 22, 24, 26, 28, 30, 32, and 34 are shown as separate spaced apart stations, the some or all of the stations 22, 24, 26, 28, 30, 32, and 34 may be combined in a single station which performs that processing of the separate stations 22, 24, 26, 28, 30, 32, and 34 in the same order as the spaced apart stations. For example, a single station may include a cutter to first cut the receptacle portion 40*a* from the filter paper 12*a*, and then a stamp to form the recess 39 in the receptacle portion 40*a*. Other stations may be similarly combined. Further, when accepting filter paper from rolls, precut filter paper may be fed and positioned onto the belt 16. Importantly, any filter paper cup manufacturing machine 10 forming a recess 39 in a pre-cut receptacle portion 40*a* is intended to come within the scope of the present invention.

The receptacle portion 40*a* and cover portion 40*b* of the filter paper cups 40 are shown in FIG. 2. The receptacle portion 40*a* include a rim 41 and recess 39. Forming the recess 39 in the receptacle portion 40*a* of the filter paper cup 40 preferably includes using heat and/or moisture to form permanent folds (or pleats) 45 in the sides 43 and rim 41 of the receptacle portion 40*a* to add strength and rigidity to the receptacle portion 40*a* so that the receptacle portion 40*a* retains its shape after forming, and preferably, adhesive is present in the filter paper 12*a* or is applied to the rim 41 and/or the sides 43 to retain the pleats and add strength and rigidity to the filter paper cup 40. Preferably, the receptacle portion 40*a* is constructed from heat sealable filter paper having a heat reacting film on at least one side, which film causes the pleats to adhere to adjacent pleats when heat is applied following forming. The pleats 45 in the rim 41 are generally continuations of the pleats in the sides 43. The receptacle portion 40*a* may alternatively be corrugated to retain shape. The receptacle portion 40*a* thus has structure for maintaining a substantially (i.e., within the ability of the paper to maintain a shape) frusto-conical or cylindrical shape unlike known coffee pods with have no structure for maintaining shape and are pillow-like with diameter much greater than depth. U.S. patent application Ser. No. 11/392,893 filed Mar. 28, 2006 filed by the present inventor, discloses a similar filter paper cup forming a coffee pod. The '893 application is herein incorporated by reference in its entirely.

Figure 3:
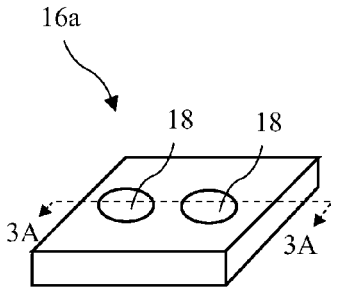
FIG. 3 is a plate element according to the present invention of a segmented belt.
Figure 3A:
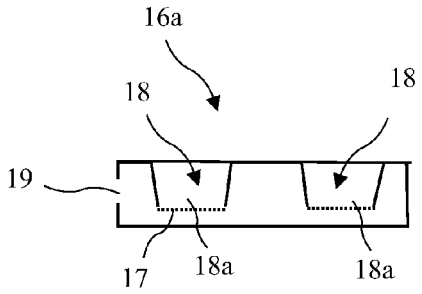
FIG. 3A is a cross-sectional view of the plate according to the present invention taken along line 3A-3A of FIG. 3.

The belt 16 may be a continuous belt or a segmented (e.g. tractor tread like) belt (or continuous chain) configured to receive plates 16*a*, allowing substitution of plates having various recess 18 sizes. A perspective view of the plate 16*a* is shown in FIG. 3 and a cross-sectional view of the plate 16*a* taken along line 3A-3A of FIG. 3 is shown in FIG. 3A. Each plate includes at least one recess 18 for forming and processing one or more receptacle portions 40*a*. A vacuum source is provided along the edge or bottom of the plates 16*a* to retain the filter paper on the plates 16*a* during processing and to remove the vacuum when the filter paper cups 40 are complete. At completion, the vacuum source may be replace by a pressure source to facilitate the finished filter paper cup 40 exit from the recess in the plate. The plates 16*a* are preferably coated with a low friction material (for example Teflon®).

The plate 16*a* includes the belt recesses 18 for receiving and shaping the receptacle portion 40*a*. The plate 16*a* preferably includes perforations 17 or other means allowing vacuum to communicate with the filter paper 12*a* for retain the position of the filter paper while forming the receptacle portion 40*a*, and a vacuum port 19 in communication with a vacuum source. An example of such a segmented belt is discloses in U.S. Pat. No. 5,649,412 incorporated by reference above.

Figure 4:
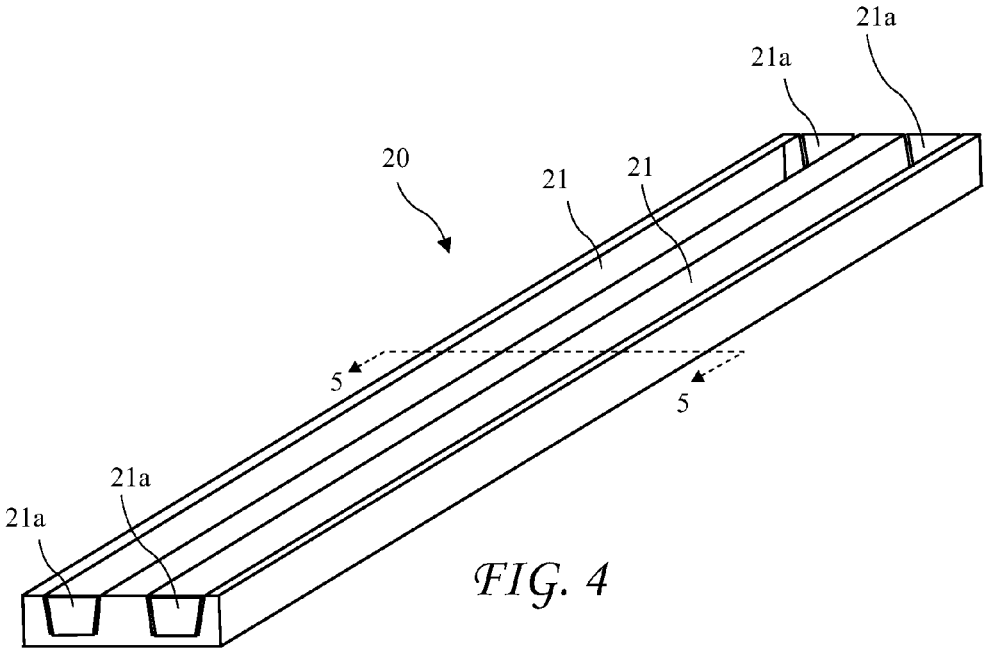
FIG. 4 is a vacuum table element of the filter paper cup manufacturing machine according to the present invention.
Figure 5:
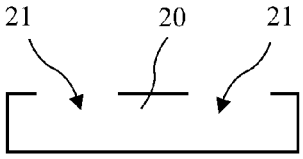
FIG. 5 is a cross-sectional view of the vacuum table element of the filter paper cup manufacturing machine according to the present invention taken along line 5-5 of FIG. 4.

An example of one vacuum source for a continuous belt 16 is the vacuum table 20 according to the present invention shown in FIG. 4 and a cross-sectional view of the vacuum table 20 taken along line 5-5 of FIG. 4 is shown in FIG. 5. The vacuum table includes gaps 21 allowing belt recesses 16 on the bottom of the continuous belt 16 to enter and leave the vacuum table 20. Gates 21*a* are formed from a flexible or deformable material at each end of the gaps 21 to limit the loss of vacuum during operation of the filter paper cup manufacturing machine 10. The gates 21*a* bend or deform when the belt recesses 16 enter or exit the vacuum table 20. Other types of gates may be used, for example, brushes reaching upward or inward and a filter paper cup manufacturing machine 10 having a vacuum table including any form of gate to limit the loss of vacuum is intended to come within the scope of the present invention.

Figure 6:
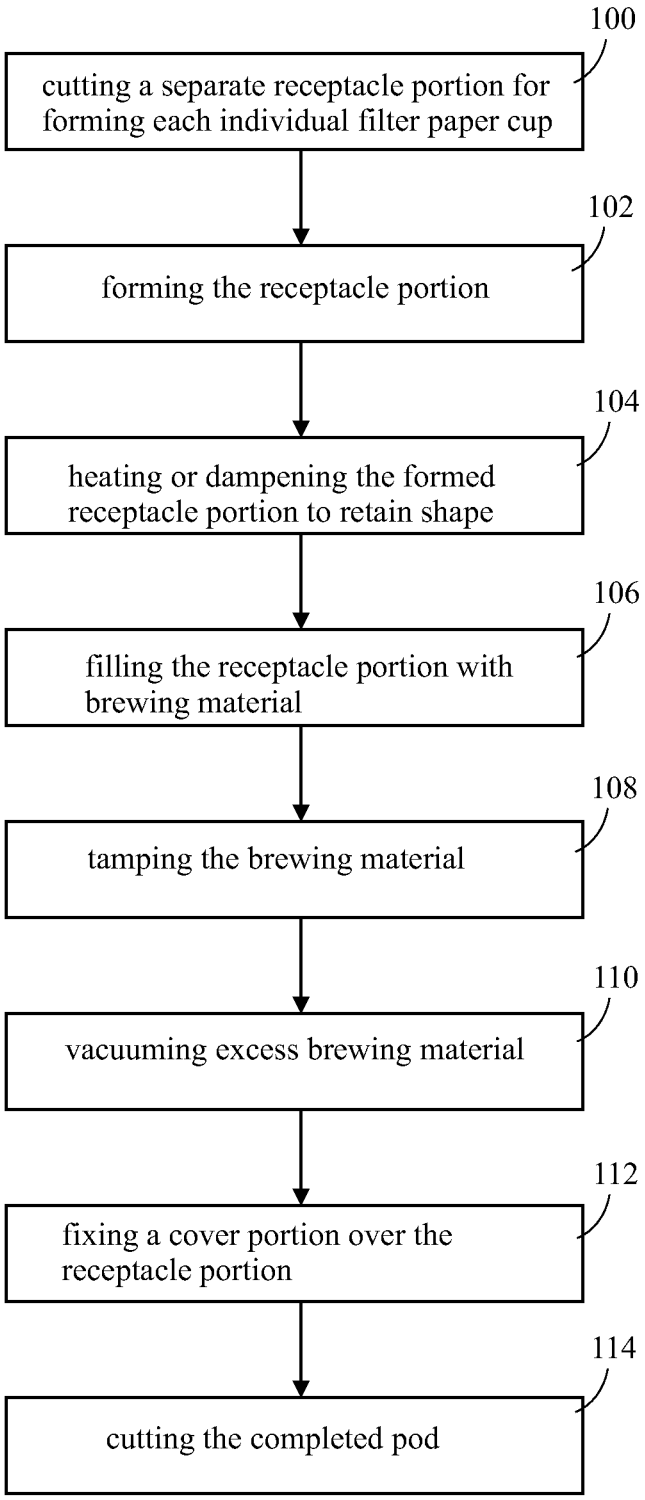
FIG. 6 is a method according to the present invention.

A method according to the present invention is shown in FIG. 6. The method includes the steps of: cutting a separate receptacle portion for forming each individual filter paper cup at step 100, forming the receptacle portion at step 102; heating or dampening the formed receptacle portion to retain shape at step 104; filling the receptacle portion with brewing material at step 106; tamping the brewing material at step 108; vacuuming excess brewing material at step 110; fixing a cover portion over the receptacle portion at step 112; and cutting the completed pod at step 114. The heating or dampening the formed receptacle portion to retain shape at step 104 is preferably heating heat sealable filter paper having a heat reacting film on at least one side to retain shape of the receptacle portion.

Figure 7:
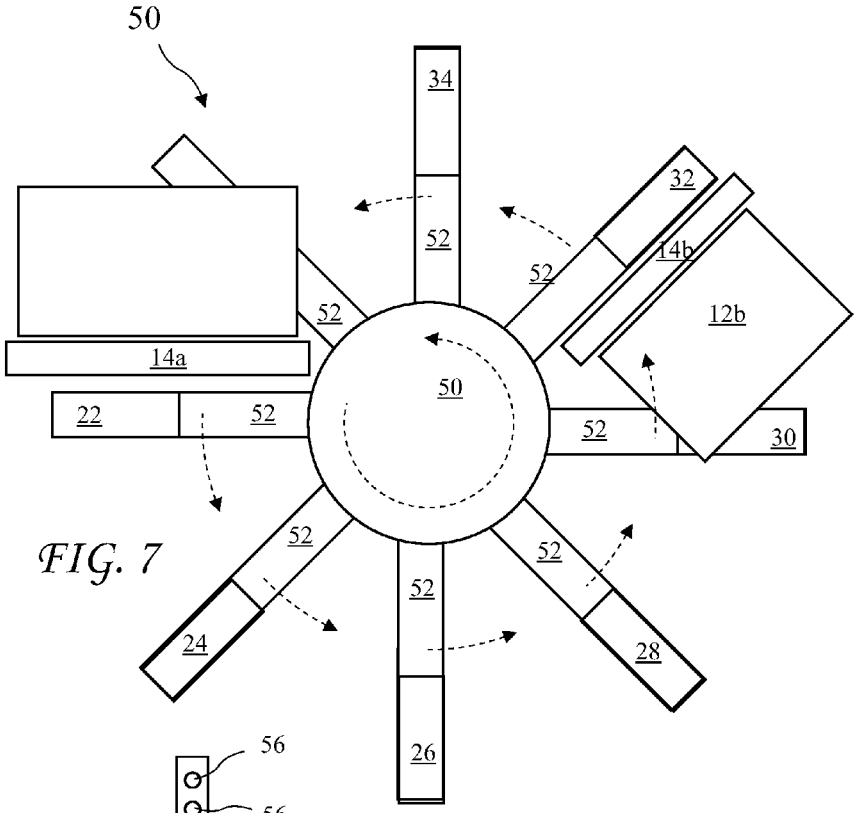
FIG. 7 shows a turret type filter paper cup manufacturing machine according to the present invention.

A turret type filter paper cup manufacturing machine 50 according to the present invention is shown in FIG. 7. The turret type filter paper cup manufacturing machine 50 includes a rotating center 50 and arms 52 rotating under the stations 22, 24, 26, 28, 30, 32, and 34 of FIG. 1. Each arm 52 may includes a vacuum source to retain the receptacle portion 40*a* position. After the cutting station 43, the arm may be rotated and the vacuum removed to allow the completed filter paper cup 40 to drop from the arm.

Figure 8:
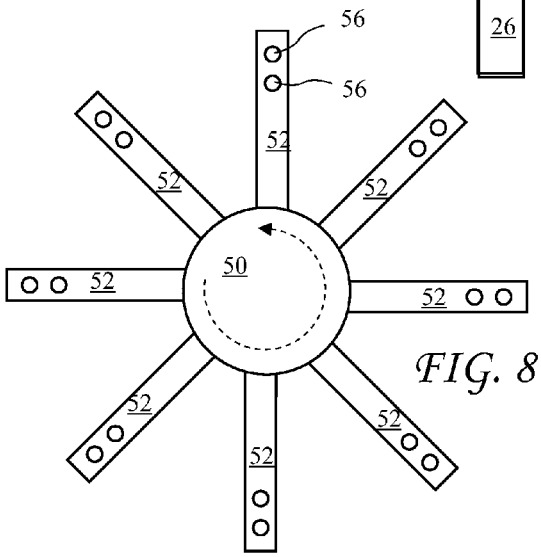
FIG. 8 shows a turret having arms of the turret type filter paper cup manufacturing machine according to the present invention.
Figure 9:
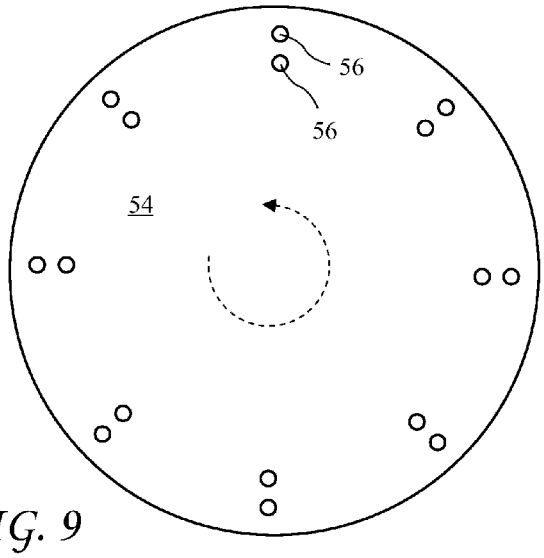
FIG. 9 shows a turret having a rotating table of the turret type filter paper cup manufacturing machine according to the present invention.

A turret having the arms 52 of the turret type filter paper cup manufacturing machine 50 is shown in FIG. 8 and a turret having a rotating table of the turret type filter paper cup manufacturing machine 50 is shown in FIG. 9. The turret includes receptacles 65 which are rotated under the stations 22-34*f* for forming the filter paper cups 40. Both the arms 52 and the table 54 may include the vacuum source for holding the filter paper during processing.

In an alternative embodiment, the horizontally turret is replaced by a vertical carrousel. The stations are positioned around the carrousel to process the filter paper to manufacture the filter paper cup. In still another embodiment, the filter paper is held fixed while the stations are moved linearly, in a horizontal circular motion (e.g., like the horizontal turret), or along a vertical arc (e.g., as along a vertical arc). When the filter paper cup is completed, the filter paper is advanced.

Figure 10:
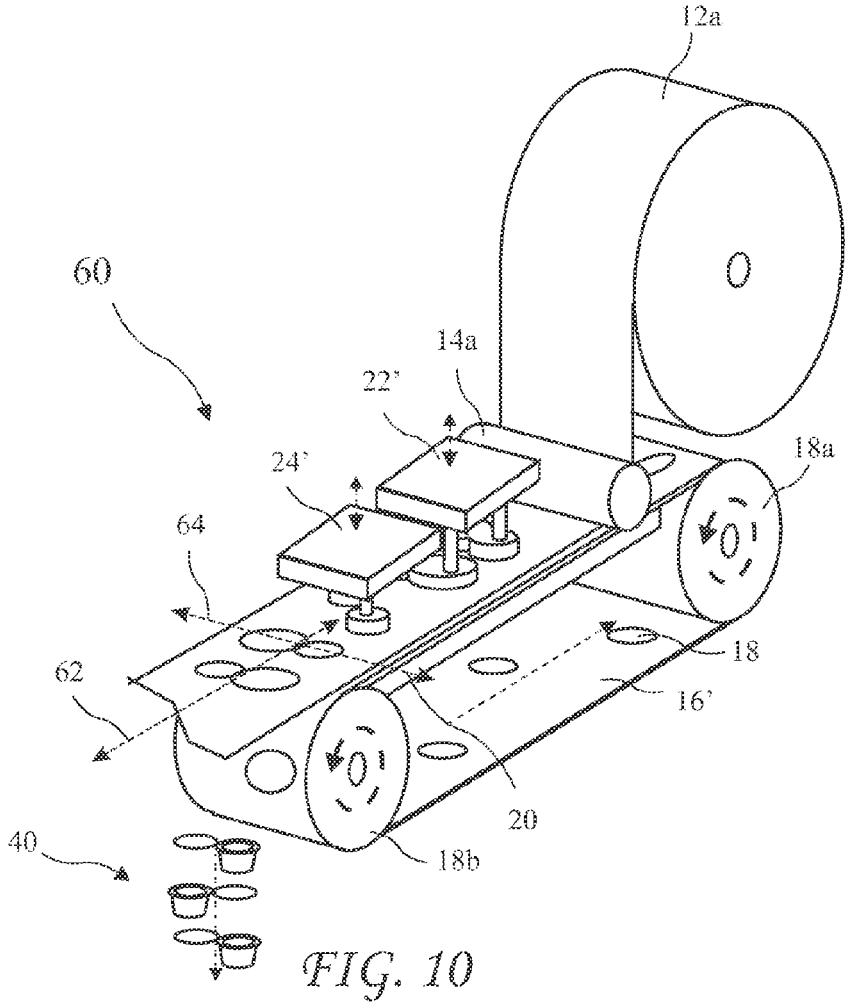
FIG. 10 shows a filter paper cup packaging manufacturing machine according to the present invention.
Figure 11A:
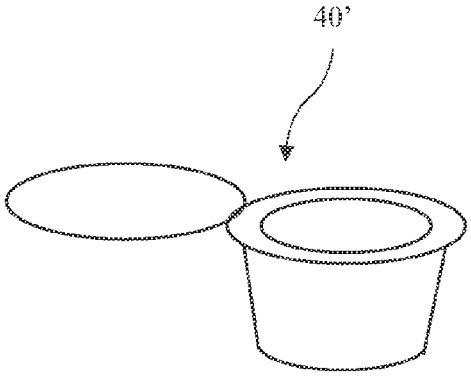
FIG. 11A shows a perspective view of an empty filter paper cup packaging according to the present invention.
Figure 11B:
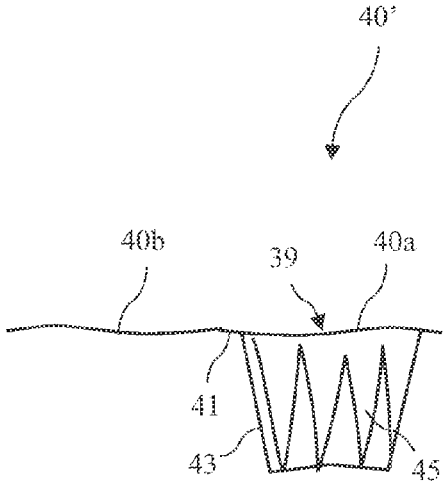
FIG. 11B shows a side view of the empty filter paper cup packaging according to the present invention.
Figure 12:
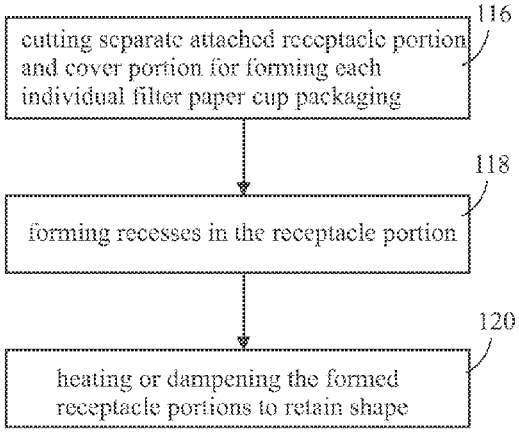
FIG. 12 is a method for manufacturing a filter paper cup packaging according to the present invention.

A filter paper cup packaging manufacturing machine 60 according to the present invention is shown in FIG. 10 and a perspective view of an empty filter paper cup packaging 40' according to the present invention is shown in FIG. 11A and a side view of an empty filter paper cup packaging 40' according to the present invention is shown in FIG. 11B. The filter paper cup packaging manufacturing machine 60 manufactures empty filter paper cups for use with a brewing material holder as disclosed in U.S. patent application Ser. No. 12,960,496 filed Dec. 4, 2010 by the present inventor. The '496 application is herein incorporated by reference.

The filter paper cup packaging 40' is preferably made from a single piece of filter paper cut from the filter paper 12*a* at station 22' with cuts for two or more filter paper cup packagings 40' in a single operation, and the recesses 39 for two or more filter paper cup packagings 40' in a single operation at station 24'. The filter paper 12*a* defines a long axis 62, and an orthogonal direction 64 orthogonal to the long axis. The filter paper cup packagings 40' are seen to have the cover portion 40*b* aligned with respect to the receptacle portion 40*a* in the orthogonal direction 64. Because each cut creates a smaller circular cut attached to a larger circular cut, the filter paper cup packagings 40' are alternated in consecutive cuts to optimize the use of the filter paper 12*a*. Just as in manufacturing the filled filter paper cups 40 described above, significantly, the filter paper is first cut, and then the recesses 39 are formed. If the filter paper 12*a* was not first cut and then formed, the forming step would tear or otherwise distort the filter paper 12*a*.

Figure 13A:
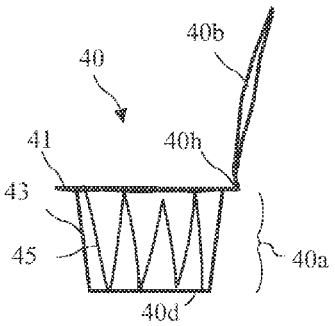
FIG. 13A shows a side view of the filter paper cup according to the present invention with the folding paper lid open.
Figure 13B:
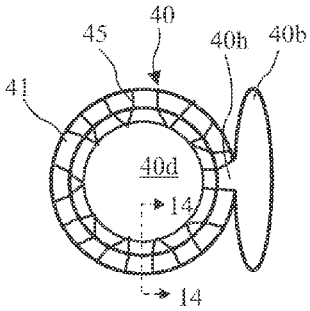
FIG. 13B shows a top view of the filter paper cup according to the present invention.
Figure 13C:
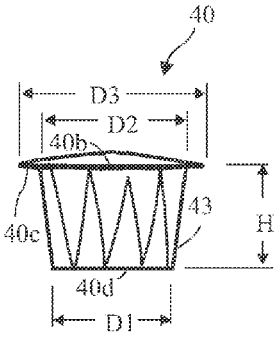
FIG. 13C shows a second side view of the filter paper cup according to the present invention with the folding paper lid closed.
Figure 14:
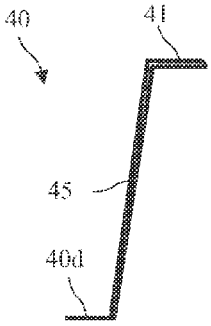
FIG. 14 is a cross-sectional view of the filter paper cup taken along line 14-14 of FIG. 13B showing folds according to the present invention.

A side view of the filter paper cup 40' with the folding paper lid 40*d* open is shown in FIG. 13A, a top view of the filter paper cup 40' is shown in FIG. 13B, a second side view of the filter paper cup 40' with the folding paper lid 40*b* closed is shown in FIG. 13C, and a cross-sectional view of the filter paper cup 40' taken along line 14-14 of FIG. 13B is shown in FIG. 14. The lid 40*b* of the filter paper cup 40' may be folded over the cup 40' and sealed after loose brewing material is poured into the cup. The filter paper cup 40' includes a receptacle 40*a* formed from a bottom 40*d*, sides 43, and a rim (or annular rim) 41, and the cover (or lid) 40*b* for closing the receptacle 40*a* to capture brewing material in the filter paper cup 40'. The filter paper cup 40' is formed using heat and/or moisture to form permanent folds (or pleats) 45 in the sides 43 and rim 41 of the filter paper cup 40' to add strength and rigidity to the filter paper cup 40' so that the filter paper cup 40' retains its shape after forming, and preferably, adhesive is applied to the rim 41 and/or the sides 43 to retain the pleats and add strength and rigidity to the filter paper cup 40'. Preferably, the filter paper cup 40' is constructed from heat sealable filter paper having a heat reacting film on at least one side, which film causes the pleats to adhere to adjacent pleats when heat is applied following forming. The pleats in the rim 41 are generally continuations of the pleats 45 in the sides 43. The filter paper cup 40' may alternatively be corrugated to retain shape. The filter paper cup 40' thus has structure for maintaining a substantially (i.e., within the ability of the paper to maintain a shape) frusto-conical or cylindrical shape unlike known coffee pods which have no structure for maintaining shape and are pillow-like. The cover 40*b* and rim 41 are connected by a hinge 40*h*. U.S. patent application Ser. No. 11/392,893 filed Mar. 28, 2006 filed by the present inventor, discloses a similar filter paper cup forming a coffee pod. The '893 application is incorporated by reference above.

The filter paper cup 40' is preferable frusto-conical shaped or cylindrically shaped and more preferably frusto-conical shaped. The filter paper cup 40' has a base diameter D1, an inner top diameter D2, an outer top diameter (the diameter of the rim) D3, and a height H. The diameter D1 is preferably approximately 1.25 inches, the diameter D2 is preferably approximately 1.625 inches, the diameter D3 is preferably approximately 2.125 inches, and the height H is preferably approximately one inch. The rim 41 is thus approximately 0.25 inches wide. The lid 40*b* has approximately the same diameter D3 as the rim 41.

While the invention herein disclosed has been described by means of specific embodiments and applications thereof, numerous modifications and variations could be made thereto by those skilled in the art without departing from the scope of the invention set forth in the claims.

I claim:

1. A method for manufacturing filter paper cup packaging, the method comprising the steps of:

a) receiving a single flat sheet of unformed filter paper from a single roll;

b) cutting a receptacle portion and cover portion from the single flat sheet of unformed filter paper for each individual filter paper cup packaging, each receptacle portion and cover portion separate from every other receptacle portion and cover portion, each receptacle portion and cover portion completely cut away from every other receptacle portion and cover portion before beginning forming receptacles in the cut filter paper portions; and c) forming a recess in the receptacle portion in the cut filter paper.

2. The method of claim 1, wherein cutting a receptacle portion and cover portion for each individual filter paper cup packaging comprises cutting the receptacle portion and cover portion for each individual filter paper cup packaging as a single piece of filter paper.

3. The method of claim 2, wherein cutting a receptacle portion and a cover portion for each individual filter paper cup packaging comprises cutting the receptacle portion larger than the cover portion and after forming the recess in the receptacle portion, the formed receptacle portion has approximately the same diameter and the cover portion.

4. The method of claim 1, further including dampening the formed receptacle portion to retain the shape of the recess.

5. The method of claim 1, wherein the filter paper includes a heat reacting film on at least one side, and the method further includes heating the formed filter paper to retain the shape of the recess in the formed receptacle portion.

6. The method of claim 5, wherein the step of forming a recess in the receptacle portion in the cut filter paper includes forming a rim around the recess in the receptacle portion in the cut filter paper before heating the formed filter paper to retain the shape of the recess.

7. The method of claim 6, further including heating the heat reacting film on the rim around the recess to retain the shape of the rim around the recess.

8. The method of claim 6, wherein forming the recess in the receptacle portion in the cut filter paper and the rim around the receptacle portion includes forming pleats in sides of the receptacle portion and in the rim.

9. The method of claim 8, wherein the filter paper includes a heat reacting film on at least one side, and heating the heat reacting film causes the pleats in the formed recess in the receptacle portion to adhere to adjacent pleats in the formed recess in the receptacle portion and the pleats in the rim around the recess to adhere to adjacent pleats in the rim around the recess.

10. The method of claim 1, wherein the step of forming a recess in the receptacle portion in the cut filter paper includes forming a frustoconical shaped recess.

11. The method of claim 10, wherein the step of forming a frustoconical shaped recess comprises forming a recess having a base diameter D1 of approximately 1.25 inches, an inner top diameter D2 of approximately 1.625 inches, and a height H of approximately one inch.

12. The method of claim 11, wherein the step of forming a frustoconical shaped recess includes forming a rim approximately 0.25 inches wide.

13. The method of claim 12, wherein cutting a receptacle portion and cover portion comprises cutting the receptacle portion and the cover portion as a single continuous piece of filter paper.

14. The method of claim 13, wherein cutting a receptacle portion and cover portion comprises cutting a smaller flat circular cut attached to a larger flat circular cut, the smaller flat circular cut for the cover and the larger flat circular cut for forming the receptacle portion.

15. The method of claim 14, further including:

providing the completed filter paper cup packaging to a user;

the user placing a single serving of brewing material into the filter paper cup;

placing the filled filter paper cup into a reusable holder;

placing the reusable holder into a coffee maker; and injecting heated liquid into the coffee holder to make a brewed drink.

16. The method of claim 14, further including:

providing the completed filter paper cup packaging to a user;

the user placing the filter paper cup into a reusable holder;

the user placing a single serving of brewing material into the filter paper cup;

placing the reusable holder into a coffee maker; and injecting heated liquid into the coffee holder to make a brewed drink.

17. The method of claim 1, wherein cutting a receptacle portion and a cover portion for each individual filter paper cup packaging comprises cutting the receptacle portion larger than the cover portion and after forming the recess in the receptacle portion comprises cutting the receptacle portion and the cover portion from the filter paper as a single piece of filter paper oriented with the cover portion laterally displaced from the receptacle portion with respect to a long axis of the filter paper.

18. The method of claim 1, wherein the orientation of the receptacle portion with respect to the cover portion is reversed in consecutive cuts of the filter paper to optimize the use of the filter paper.

19. A method for manufacturing filter paper cup packaging, the method comprising the steps of:

receiving heat sealable filter paper from a single roll;

cutting a receptacle portion and a cover portion from the same filter paper from the same single roll for forming individual filter paper cups, each receptacle portion and cover portion cut to be separate from each other receptacle portion and cover portion;

completing the cutting of the receptacle portion and the cover portion;

after completing the cutting of the receptacle portion and the cover portion, forming a recessed cup in the receptacle portion and a generally flat and horizontal rim around a top of the recessed cup; and heating the formed receptacle portion to retain shape.

20. A method for manufacturing and using filter paper cup packaging, the method comprising the steps of:

making a filter paper cup packaging comprising the steps of:

receiving heat sealable filter paper from a single roll;

cutting a receptacle portion and a cover portion from the same filter paper from the same single roll for forming individual filter paper cups, each receptacle portion and cover portion cut to be separate from each other receptacle portion and cover portion, each receptacle portion and cover portion completely cut away from every other receptacle portion and a cover portion before beginning forming receptacles in the cut filter paper portions;

forming a recessed cup in the receptacle portion and a generally flat and horizontal rim around a top of the recessed cup; and heating the formed receptacle portion to retain shape; and using filter paper cup packaging comprising the steps of:

providing the completed and empty filter paper cup packaging to a user;

the user placing the filter paper cup into a reusable holder;

the user placing a single serving of brewing material into the filter paper cup;

placing the reusable holder into a coffee maker; and injecting heated liquid into the coffee holder to make a brewed drink.

* * * * *